US007255658B1

(12) United States Patent
VanKuiken et al.

(10) Patent No.: US 7,255,658 B1
(45) Date of Patent: Aug. 14, 2007

(54) BASEBALL EQUIPMENT BUCKET AND PITCHING TARGET

(76) Inventors: Jack C. VanKuiken, 2244 Ridgewood Rd., Lisle, IL (US) 60532; Christopher Jon Mackie, 7174 Spring Hill Rd., Lewisville, NC (US) 27023

( * ) Notice: Subject to any disclaimer, the term of this patent is extended or adjusted under 35 U.S.C. 154(b) by 102 days.

(21) Appl. No.: 11/225,264

(22) Filed: Sep. 13, 2005

(51) Int. Cl.
*A63B 69/00* (2006.01)

(52) U.S. Cl. ..... 473/454; 473/456; 473/417

(58) Field of Classification Search ..... 473/417, 473/431, 451, 387, 454, 456, 422, 434, 435; 124/16, 17, 37
See application file for complete search history.

(56) References Cited

U.S. PATENT DOCUMENTS

| | | | | | |
|---|---|---|---|---|---|
| 2,527,906 | A | * | 10/1950 | Bennett et al. | 473/417 |
| 2,976,041 | A | * | 3/1961 | White | 473/417 |
| 3,399,889 | A | * | 9/1968 | Harry | 473/481 |
| 3,474,771 | A | * | 10/1969 | Breslow et al. | 124/16 |
| 3,545,752 | A | * | 12/1970 | Hill et al. | 124/16 |
| 3,716,234 | A | * | 2/1973 | Lancellotti | 473/481 |
| 3,852,477 | A | * | 12/1974 | Venter et al. | 426/15 |
| 3,997,158 | A | | 12/1976 | Britton | |
| 4,365,814 | A | * | 12/1982 | Robinson | 273/317 |
| 4,489,941 | A | * | 12/1984 | Shieh | 473/197 |
| 4,629,188 | A | | 12/1986 | Mahieu | |
| 4,830,369 | A | | 5/1989 | Poitras | |
| 4,969,660 | A | * | 11/1990 | Spak | 280/646 |
| 4,993,708 | A | * | 2/1991 | Prossor et al. | 473/417 |
| 5,320,343 | A | | 6/1994 | McKinney | |
| 5,516,115 | A | | 5/1996 | McLain | |
| 5,722,905 | A | * | 3/1998 | Bidelman | 473/451 |
| 5,803,841 | A | | 9/1998 | Daskowski | |
| 6,099,417 | A | * | 8/2000 | Brown et al. | 473/417 |
| 6,135,900 | A | | 10/2000 | McGrath | |
| 6,296,581 | B1 | * | 10/2001 | Sever | 473/422 |
| 6,443,859 | B1 | * | 9/2002 | Markin | 473/451 |
| 6,565,459 | B2 | * | 5/2003 | Gormley | 473/423 |
| 6,663,513 | B2 | | 12/2003 | Howard | |
| 6,695,725 | B1 | | 2/2004 | Burns | |
| 6,837,809 | B2 | | 1/2005 | Majumdar | |
| 2006/0199672 | A1 | * | 9/2006 | Flanigan | 473/417 |
| 2006/0205540 | A1 | * | 9/2006 | Liu | 473/417 |

* cited by examiner

*Primary Examiner*—Mitra Aryanpour
(74) *Attorney, Agent, or Firm*—Philiip H. Kier

(57) ABSTRACT

A portable bucket for carrying baseball equipment (such as bases, gloves, balls) that is attached to a pitching target. The bucket, a bottom mounting bracket, a top mounting bracket and an extendable frame provide support for the pitching target. The pitching target can be folded and snapped to the lower mounting bracket when the invention is being carried. The target is positioned for play by fully extending the frame, unsnapping the pitching target from the lower mounting bracket, rotating it, unfolding it, and then fastening it to the extendable frame. Also attached to the bucket could be tubes for carrying baseball bats or holding a tee for tee-ball, or wheels to assist in transport.

24 Claims, 6 Drawing Sheets

BASEBALL EQUIPMENT BUCKET AND PITCHING TARGET

BACKGROUND OF THE INVENTION

This invention is apparatus for playing a form of baseball. More particularly, it refers to a readily portable bucket for holding baseball equipment attached to a foldable pitching target best suited for use with a light-weight ball, rather than a regulation baseball.

A number of types of devices have been developed to act as a target for thrown balls to improve a pitcher's skills for pitching or batting practice. Some of these use netting with a tubular supports such as U.S. Pat. No. 5,516,115 to McLain, and U.S. Pat. No. 5,803,841 to Daskoski, or netting in a collapsible assembly for compact transport such as U.S. Pat. No. 5,722,905 to Bidelman. Other target may be resilient when struck with a balls such as the pitching target with an adjustable target taught by Mahien in U.S. Pat. No. 4,629,188, or may consist of an array panels wherein an electric circuit is completed when a panel is struck.

SUMMARY OF THE INVENTION

The present invention includes a foldable rectangular pitching target made of corrugated plastic that is attached to a support system that includes a bucket that can be loaded with baseball equipment, such as bases, balls, or gloves. Attached to the bucket could be tubes for holding bats or tees for tee-ball and the bucket could be covered with a seat. The support system has a stationary bottom mounting bracket, a stationary top mounting bracket, both attached to the bucket, and an extendable (telescoping) frame attached to the stationary mounting brackets. The target folds into two or more rectangular sections and is riveted to the top mounting bracket such that it can pivot. When the invention is not in use, the target is folded, with the folds vertical, and further attached to the lower mounting bracket and with the telescoping frame in its lowest position. When the invention is prepared for use, the extendable frame is raised, the pitching target is unsnapped from the lower front section, the target is unfolded, rotated 90 degrees, and attached to the raised telescoping frame. Means for attachment to the raised frame can include snaps, toggles, an elastic strap, or straps with self adhering pads. The extendable frame, which is without sharp edges, is preferably provided by a telescoping handle arrangement as typically designed for wheeled luggage. The extendable frame may also have wheels to ease transporting the apparatus. The invention is best suited for use with a light-weight ball, such as a hollow plastic ball, foam ball, or tennis ball. However, it can be used with a regulation baseball if thrown by a younger child, or if the pitching target is made of heavy gage corrugated plastic and the bucket is filled with a heavy material such as sand.

The invention has several objects. One object is to provide a readily transportable, compact means to carry a complete baseball game set so that a base field could be readily set up and play could occur. Another object is to provide an easily transportable pitching target. Still another object is to provide a pitching target that minimizes hazards by having a support system without sharp corners. In addition, another object is to provide an adjustable batting tee for game and hitting practice, tubes for holding bats, and a bucket for holding baseball equipment.

BRIEF DESCRIPTION OF THE SEVERAL VIEWS

Figure 6:
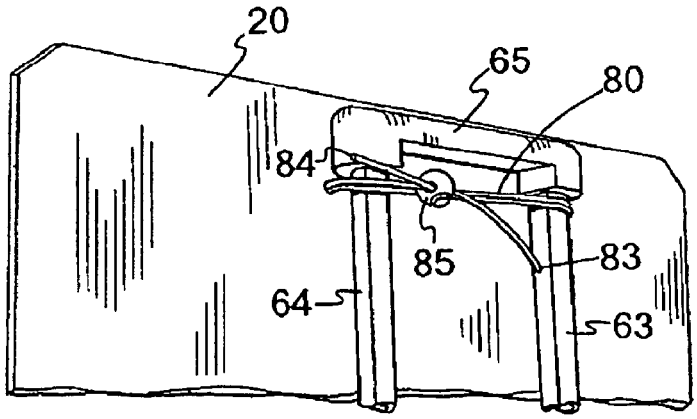
FIG. 6 is a partial back view of the pitching target and extendable frame with elastic cord and toggle fastening means.
Figure 6A:
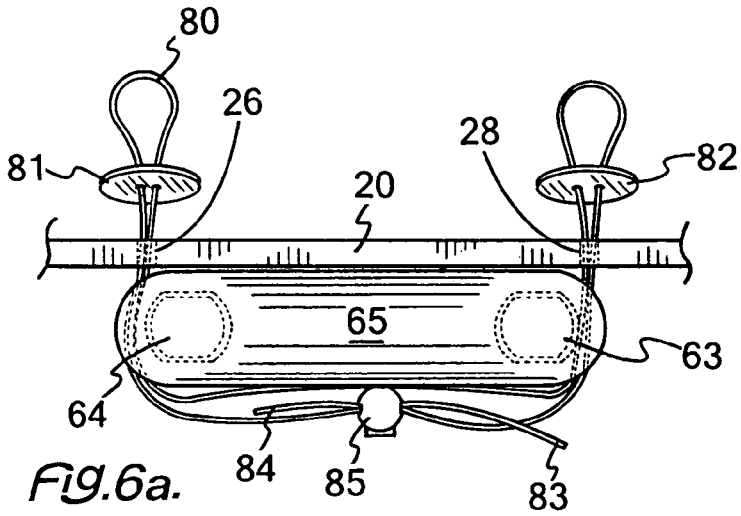

FIG. 6*a* is a top view of the pitching target and extendable frame with elastic cord and toggle fastening means.

Figure 7:
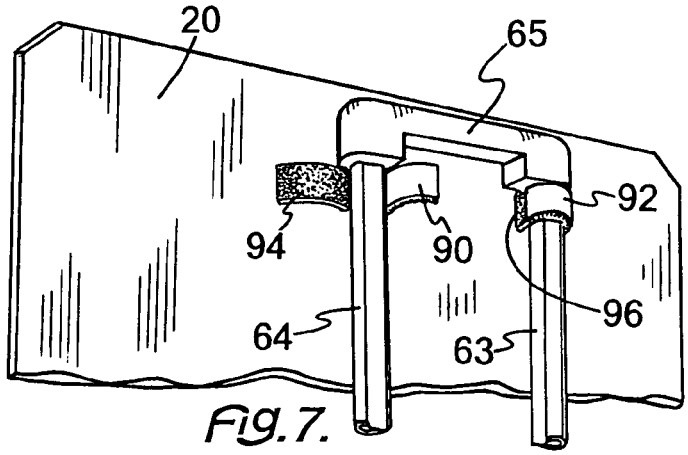

FIG. 7 is a partial back view of the pitching target and extendable frame with straps and adhering pads fastening means.

Figure 7A:
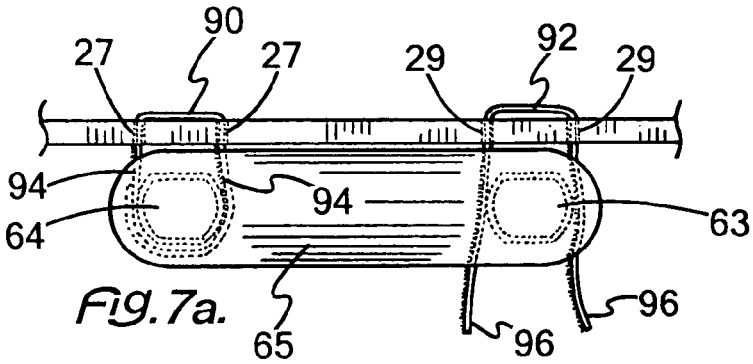

FIG. 7*a* is a top view of the pitching target and extendable frame with straps and adhering pads fastening means.

Figure 8:
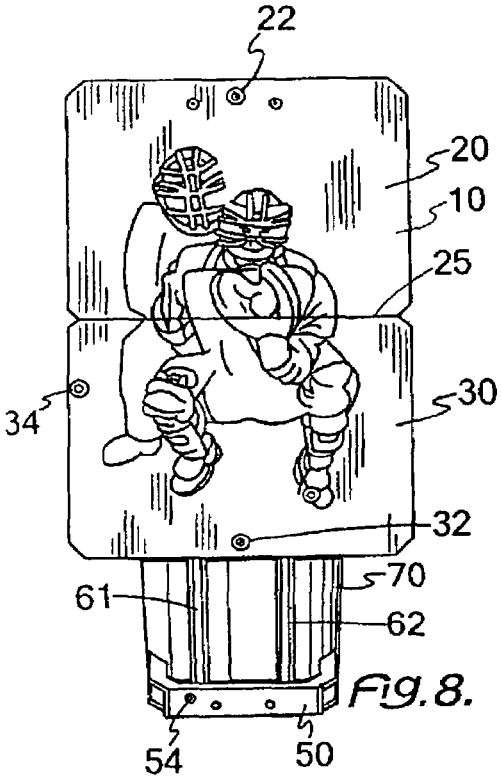

FIG. 8 is a front view of the invention with the pitching target in play position.

Figure 9:
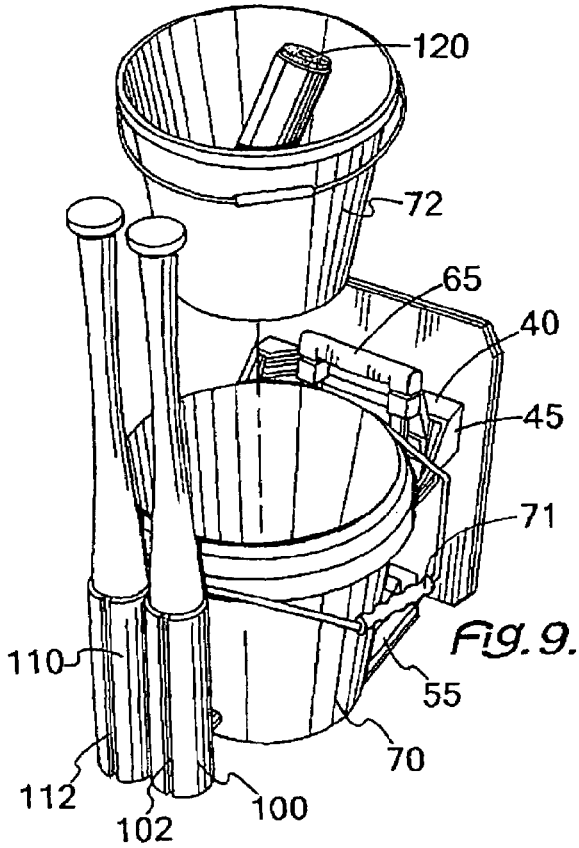

FIG. 9 is a back perspective view of the invention showing a pail.

Figure 10:
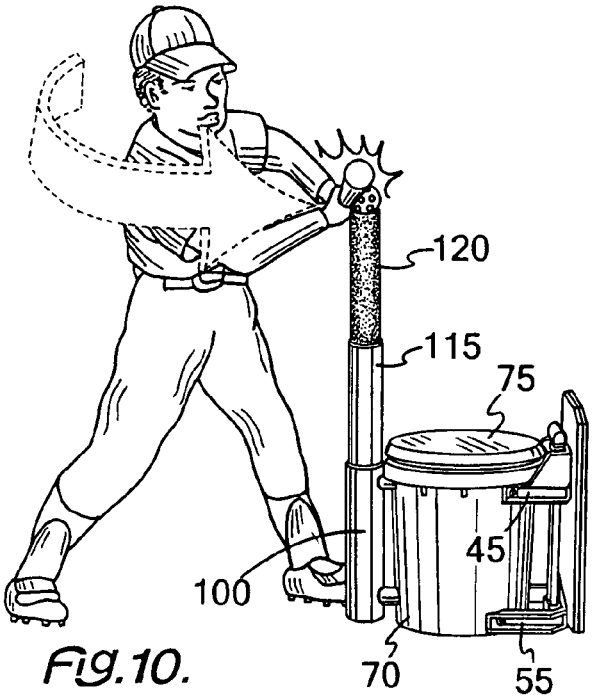

FIG. 10 is a side view of the invention with a tube containing an insert and tee in position for tee ball.

Figure 11:
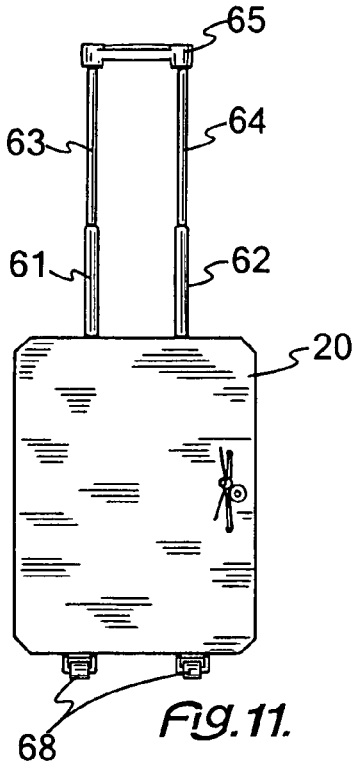

FIG. 11 is a front view of the invention with the pitching target folded and with the extendable frame having wheels.

Figure 12:
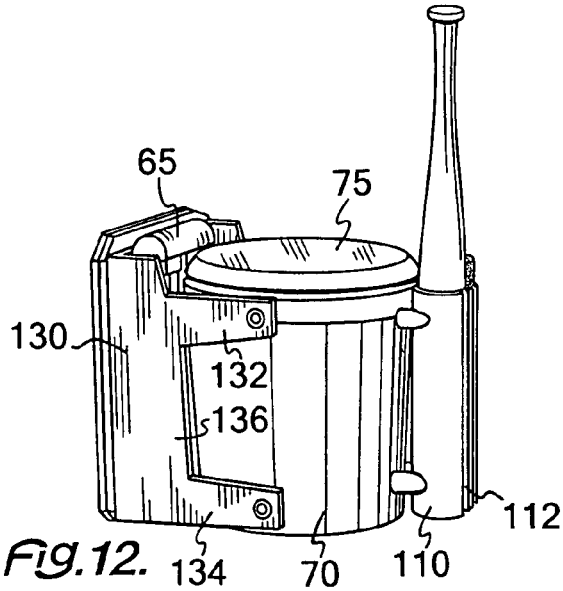

FIG. 12 is a side perspective view of the invention with a single mounting bracket configuration.

DETAILED DESCRIPTION OF THE INVENTION

Figure 1:
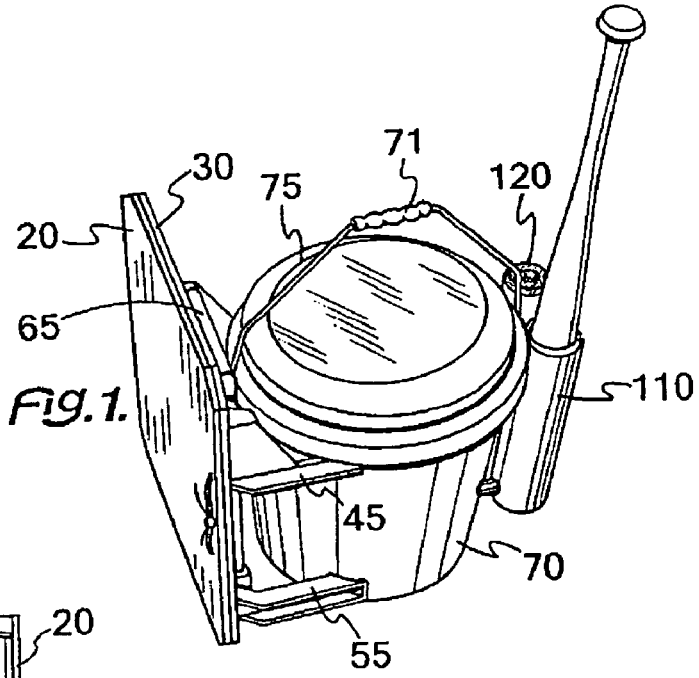
FIG. 1 is a perspective view of the invention with the pitching target folded for carrying.
Figure 2:
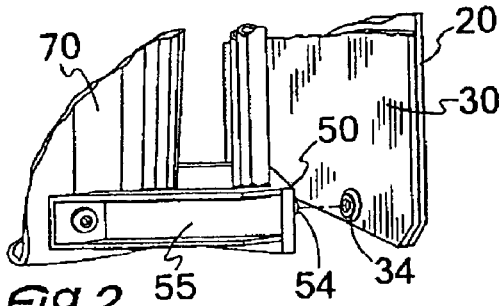
FIG. 2 is a partial side view of the invention of the bottom mounting bracket and folded pitching target.
Figure 3:
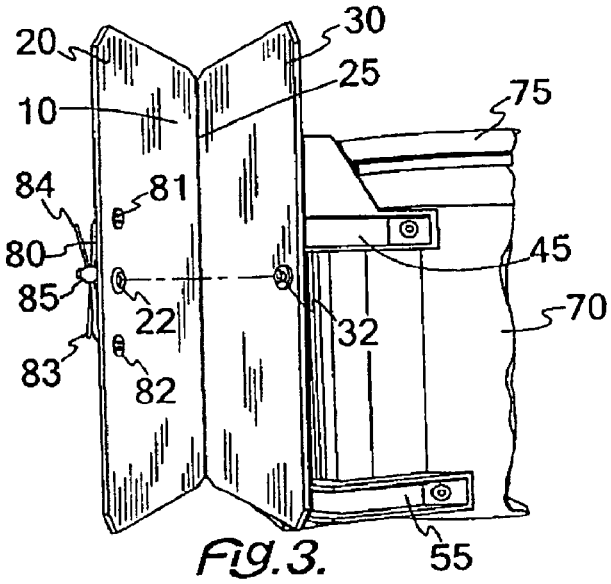
FIG. 3 is a side view of the invention with the pitching target partly open.
Figure 4:
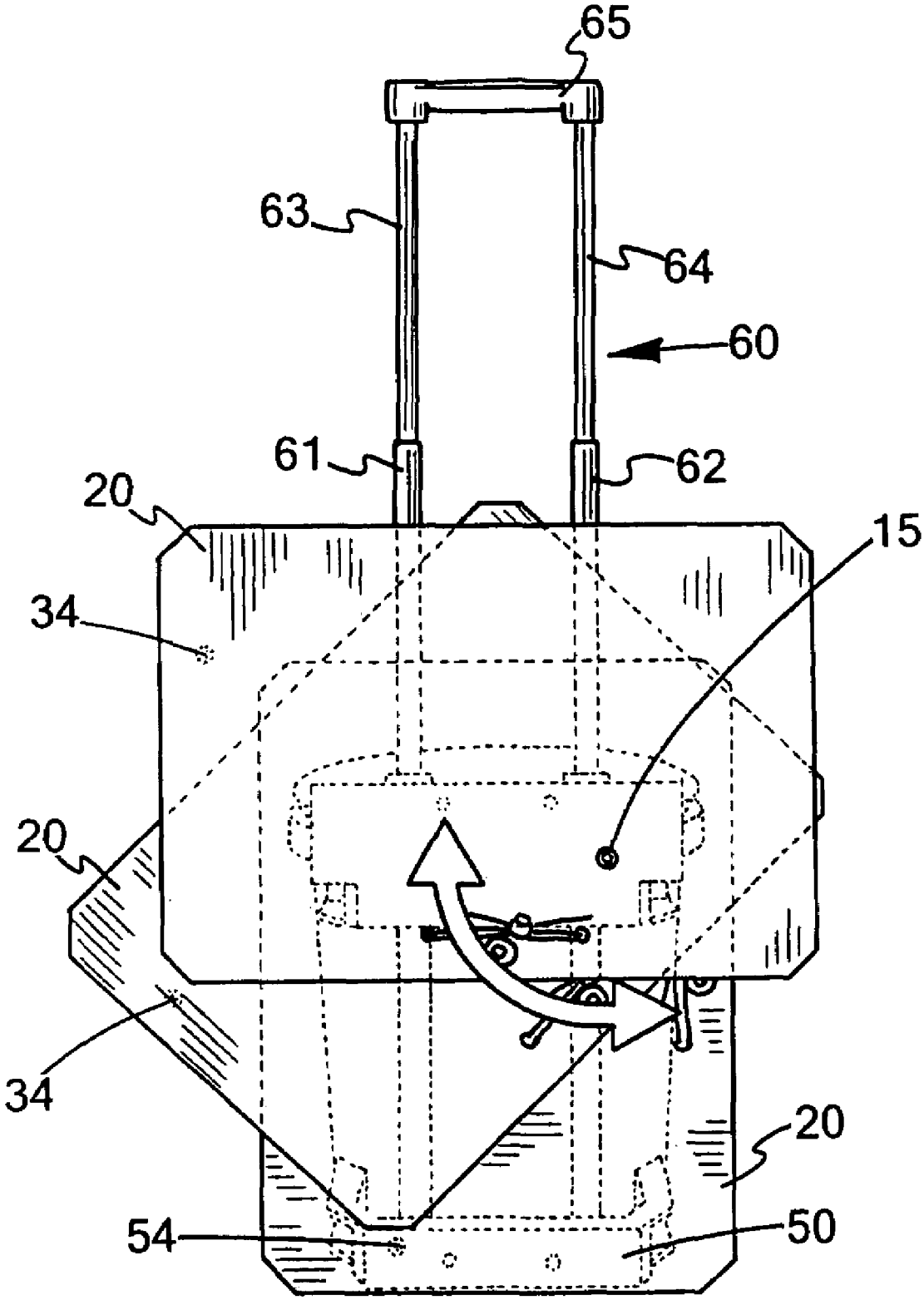
FIG. 4 is a front view of the invention with the pitching target partly rotated.

The basic components of the invention, as shown in several figures, are a rectangular pitching target 10, a top mounting bracket 40, a bottom mounting bracket 50, an extendable vertical frame 60 that attaches to the top and bottom mounting brackets, and a bucket 70. The top mounting bracket 40 has two arms 45 on opposite sides of a central section that attach to opposite sides of the bucket. The bottom mounting bracket 50 has two arms 55 on opposite sides of a central section that also attach to opposite sides of the bucket. The extendable frame has stationary legs 61 and 62, movable legs 63 and 64 and handle 65 integrally attached to the movable legs. Leg 63 telescopes with leg 61 and leg 64 telescopes with leg 62. The upper and lower mounting brackets are permanently attached to the stationary legs of the extendable frame, which is contained between the bucket and the mounting brackets. The mounting brackets' arms, 45 and 55, are permanently attached to the bucket. The pitching target folds into two rectangular sections in the preferred embodiment, an upper section 20, and a lower section 30 with fold 25 between them, as shown in FIG. 3. The lower section 30 of the target is permanently attached to the top mounting bracket 40 by means, such as a rivet 15 located in the lower section of the target that allows the target to pivot relative to the top mounting bracket. As shown in FIG. 4, the pivot is located to the right of the center of the upper mounting bracket. When the apparatus is being transported to the playing field, fold 25 is vertical, the target is folded, and the sections of the target are fastened to each other. The preferred fastening means is a pair of mated snaps, 22 on upper section 20 and 32 on lower section 30 as shown in FIG. 3. The snaps are located near the edge of the respective target section that is opposite to fold 25. As shown in FIG. 2, the lower section of the target is also fastened to the lower mounting bracket by means of mated snaps 34 on the lower section of the target and 54 on the central section of the lower mounting bracket 50.

Figure 5:
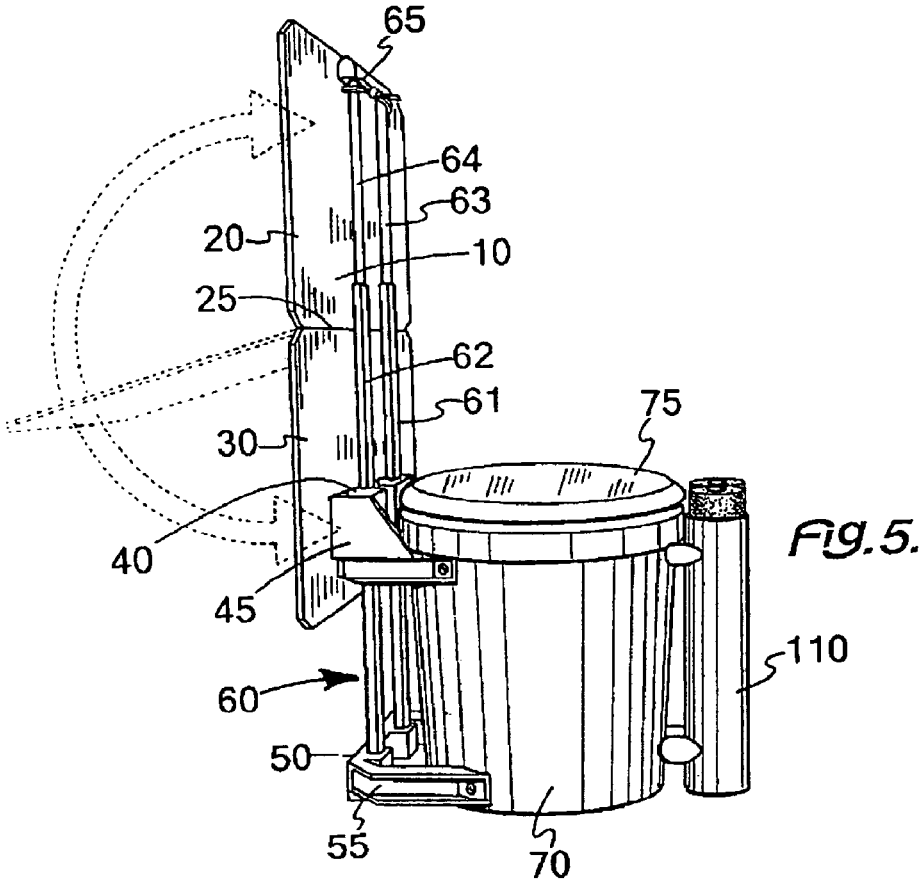
FIG. 5 is a side view of the invention with the pitching target open and fastened to the extendable frame.

When the apparatus has been positioned in a field for play, the two sections of the target are unfastened by unsnapping snaps 22 and 32. Also the lower section 30 is unfastened from the lower mounting bracket by unsnapping snaps 34 and 54. Then, as shown in FIGS. 3-5, the target is unfolded and rotated 90 degrees around the pivot point so that fold 25 is horizontal and the upper target section 20 is above the lower target section 30. In play, the target is being continually subject to impact when it is struck by a pitched ball. To help keep the target stationary by providing stability, the bottom of the lower mounting bracket 50 and the bottom of the bucket 70 should be flush against the ground. Stability can be further enhanced by having a heavy object such as a small sandbag in the bucket. Rivet 15 is eccentrically positioned so that pivoting the target will yield proper alignment for play when open, and simultaneously proper alignment for transport when folded and rotated. Prior to play, handle 65 of extendable frame 60 is raised to its fully extended position and the back of the target 10 is fastened to movable legs 63 and 64 near handle 65.

Several fastening means could be used such as snaps, toggles, self-adhering pads, or elastic cord. One fastening means is elastic cord 80 and an adjustment toggle 85 as shown in FIGS. 6 and 6*a*. The elastic cord with two ends 83 and 84 is looped through holes in buttons 81 and 82, then passes through target holes 26 and 28 such that two sections pass through the holes. The target holes are near the top of the top section of the target. Both sections are stretched to pass around movable legs 63 and 64. Ends 83 and 84 pass through adjustment toggle 85, which is then tightened to hold buttons 81 and 82 firm against the front of the target and to secure the back of the target to the expandable frame 60. In another embodiment shown in FIGS. 7 and 7*a* the target is secured to the legs of the extendable frame by means of straps 90 and 92 with self-adhering pads 94 and 96, respectively. Each strap is passed through a slit, 27 or 29, wrapped around a leg of the extendable frame, and then the self-adhering pads are brought into contact to secure the target to the extendable frame.

The target is sized to be approximately the size of a strike zone when unfolded and in play orientation. Each section of the target is approximately 46 cm (18 inches) wide and 33 cm (13 inches) high. In the unfolded position when deployed, the target is approximately 46 cm (18 inches) wide and 66 cm (26 inches) high. The pivot point rivet might be approximately 9 cm (3.5 inches) from a longer edge and 15 cm (6 inches) from a shorter edge of the lower target section 30 for proper alignment. FIG. 8 shows how the target might look to a pitcher when in play position.

The invention may have additional components. Attached to the back of the bucket could be tubes. In the embodiment shown in the drawings there are two tubes 100 and 110. As shown in FIG. 9, each tube may have a vertical slit, 102 and 112, respectively, so that the diameter of a tube may expand to accommodate bats with different diameters. The tubes could be used to carry bats or one tube 100 could carry a smaller diameter insert 115 that fits tightly in tube 100. As shown in FIG. 10, insert 115 could be topped with a foam tube 120, which could be used as a tee for playing tee-ball or for batting practice. The bottoms of tubes 100 and 110 should be flush against the ground to enhance stability. The bucket 70 could contain a pail 72 for holding balls, gloves, or bases. The bucket could also have a handle 71 attached to it and a cover 75 that acts as a seat. The apparatus could be lifted by bucket handle 71 for transport to and from a playing field. An embodiment consisting of the bucket and tubes alone would be useful for carrying baseball equipment.

To facilitate movement of the apparatus to and from a playing field, the apparatus may have wheels 68. To reduce the cost of manufacture by possibly using "off-the shelf" components, the wheel could be on the extendable frame 60, such as the handles of wheeled luggage that have attached wheels. The apparatus can then be wheeled to and from the playing field. The embodiment is shown in FIG. 11. These wheels could not compromise the stability of the apparatus during play. The wheel would cause the lower mounting bracket and the bucket to tilt slightly down toward the rear of the apparatus. When a ball strikes the target, its impact would cause the rear of the apparatus to contact the ground to prevent movement. Alternatively, the wheels could be elevated sufficiently to contact the ground only when the apparatus is tilted forward for wheeling.

In the embodiment shown in FIG. 12, there is a single mounting bracket 130, with upper arms 132 and lower arms 134 attached to bucket 70. The single mounting bracket is essentially integration of top mounting bracket 40 and bottom mounting bracket 50 with side section 136 integrally formed with upper arm 132 and lower arm 134. The single mounting bracket embodiment offers greater stability than the two mounting bracket embodiment, but at the expense of greater weight.

The bucket and mounting brackets could be made of a number of different kinds of plastic materials such as polypropylene (PP) or polyethylene (PE), and various types of polyurethane (PU) or PE could be used for foam tubing (for batting tees). The target is preferably made of corrugated plastic, which provides preferred properties such as resistance to water exposure, light weight, and high rigidity. When the target is used and a light ball is thrown, a thickness of 0.3 cm (1 inch) to 0.5 cm (2 inch) is adequate. The target could be used when a regulation baseball is thrown with sufficiently low speed, such as by a child under 10 years of age. In this case, a heavier gauge corrugated plastic, such as 5 mm or greater could be used.

We claim:

1. A baseball equipment and pitching target system comprising:

a rectangular pitching target foldable into an upper section and a lower section with a first fastening means for fastening the upper section and the lower section together, and a second fastening means;

a stationary top mounting bracket to which the pitching target is pivotably attached;

a stationary bottom mounting bracket having mate second fastening means that align with the second fastening means on the pitching target when the pitching target is folded;

an extendable frame with stationary components and movable components that telescope with the stationary components, the extendable frame attached to the top and bottom mounting brackets;

means for securing the target when unfolded to the movable components of the extendable frame when extended and a bucket attached to the top mounting bracket and to the bottom mounting bracket.

2. A baseball equipment and pitching target system as set forth in claim 1 wherein the stationary components of the extendable frame are plural legs, the movable components of the extendable frame are plural legs where each movable leg telescopes with a stationary leg, and a handle that is integrally attached to each movable leg.

3. A baseball equipment and pitching target system as set forth in claim 1 wherein the first fastening means and mate first fastening means and second fastening means and mate second fastening means are snaps.

4. A baseball equipment and pitching target system as set forth in claim 1 further comprising a plurality of tubes, with an inner diameter that can accommodate a baseball bat, attached to the bucket.

5. A baseball equipment and pitching target system as set forth in claim 4 wherein each tube has a slit.

6. A baseball equipment and pitching target system as set forth in claim 5 wherein one of the tubes attached to the bucket further has a tightly fitting extending inner tube and a foam tee.

7. A baseball equipment and pitching target system as set forth in claim 1 further comprising a cover for the bucket capable of supporting a person's weight.

8. A baseball equipment and pitching target system as set forth in claim 1 further comprising a pail that fits in the bucket.

9. A baseball equipment and pitching target system as set forth in claim 1 wherein the pitching target is made of corrugated plastic.

10. A baseball equipment and pitching target system as set forth in claim 1 wherein the means for securing the unfolded target to the movable components of the extendable frame is an elastic cord secured to the top section of the target and extended around the movable components of the extendable frame through holes in the top section of the target and secured to the movable components of the extendable frame.

11. A baseball equipment and pitching target system as set forth in claim 1 wherein the means for securing the unfolded target to the movable components of the extendable frame are straps with self-adhering pads looped though slips in the top section of the target and with each strap wrapped around a movable component of the extendable frame with the self-adhering pads aligned.

12. A baseball equipment and pitching target system comprising:

a rectangular pitching target foldable into upper section and a lower section with a first fastening means for fastening the upper section and the lower section together, and a second fastening means;

a mounting bracket section to which the pitching target is pivotably attached; the mounting bracket section having mate second fastening means that align with the second fastening means on the pitching target when the pitching target is folded, and having two side sections, each side section having top and bottom arms;

an extendable frame with stationary components and movable components that telescope with the stationary components, the extendable frame attached to the mounting bracket section;

means for securing the target when unfolded to the movable components of the extendable frame when extended and a bucket attached to the top arms and the bottom arms of the mounting bracket.

13. A baseball equipment and pitching target system as set forth in claim 12 wherein the stationary components of the extendable frame are plural legs, the movable components of the extendable frame are plural legs where each movable leg telescopes with a stationary leg, and a handle that is integrally attached to each movable leg.

14. A baseball equipment and pitching target system as set forth in claim 12 wherein the first fastening means and mate first fastening means and second fastening means and mate second fastening means are snaps.

15. A baseball equipment and pitching target system as set forth in claim 12 further comprising a plurality of tubes, with an inner diameter that can accommodate a baseball bat, attached to the bucket.

16. A baseball equipment and pitching target system as set forth in claim 15 wherein each tube has a slit.

17. A baseball equipment and pitching target system as set forth in claim 16 wherein one of the tubes attached to the bucket further has a tightly fitting extending inner tube and a foam tee.

18. A baseball equipment and pitching target system as set forth in claim 12 further comprising a cover for the bucket capable of supporting a person's weight.

19. A baseball equipment and pitching target system as set forth in claim 12 further comprising a pail that fits in the bucket.

20. A baseball equipment and pitching target system as set forth in claim 12 wherein the pitching target is made of corrugated plastic.

21. A baseball equipment and pitching target system as set forth in claim 12 wherein the means for securing the unfolded target to the movable components of the extendable frame is an elastic cord secured to the top section of the target and extended around the movable components of the extendable frame through holes in the top section of the target and secured to the movable components of the extendable frame.

22. A baseball equipment and pitching target system as set forth in claim 12 wherein the means for securing the unfolded target to the movable components of the extendable frame are straps with self-adhering pads looped though slips in the top section of the target and with each strap wrapped around a movable component of the extendable frame with the self-adhering pads aligned.

23. A baseball equipment and pitching target system as set forth in claim 1 further comprising wheels attached to the extendable frame.

24. A baseball equipment and pitching target system as set forth in claim 12 further comprising wheels attached to the extendable frame.

* * * * *